US007237655B2

(12) United States Patent
Kocher

(10) Patent No.: US 7,237,655 B2
(45) Date of Patent: Jul. 3, 2007

(54) ELEVATOR SYSTEM AND METHOD FOR PREVENTING UNAUTHORIZED HOISTWAY ACCESS

(75) Inventor: Johannes Kocher, Udligenswil (CH)

(73) Assignee: Inventio AG, Hergiswil (CH)

( * ) Notice: Subject to any disclaimer, the term of this patent is extended or adjusted under 35 U.S.C. 154(b) by 632 days.

(21) Appl. No.: 10/790,581

(22) Filed: Mar. 1, 2004

(65) Prior Publication Data

US 2004/0173415 A1 Sep. 9, 2004

(30) Foreign Application Priority Data

Mar. 5, 2003 (EP) ..... 03405151

(51) Int. Cl.
*B66B 13/14* (2006.01)

(52) U.S. Cl. ..... 187/314; 187/339

(58) Field of Classification Search ..... 187/313, 187/316, 317, 414, 279, 280, 314; 49/25, 49/26, 28; 318/466–469, 280–286
See application file for complete search history.

(56) References Cited

U.S. PATENT DOCUMENTS 5,727,657 A * 3/1998 Foelix ..... 187/356
6,138,798 A * 10/2000 Macuga ..... 187/294
6,223,861 B1 * 5/2001 Sansevero ..... 187/316

FOREIGN PATENT DOCUMENTS

| | | |
|---|---|---|
| EP | 1 030 008 A1 | 8/2000 |
| GB | 1 498 039 | 1/1978 |
| GB | 1 511 838 | 5/1978 |
| JP | 8-59151 | 3/1996 |
| JP | 2000-72361 | 3/2000 |

* cited by examiner

*Primary Examiner*—Jonathan Salata
(74) *Attorney, Agent, or Firm*—Klaus P. Stoffel; Wolff & Samson PC

(57) ABSTRACT

An arrangement and method for preventing unauthorized access of personnel into the hoistway of an elevator system. The arrangement includes a security device for mounting in the vicinity of an auxiliary release mechanism of a landing door to prevent actuation of the auxiliary release mechanism during normal operating conditions. The security device includes an energization circuit which, in use, is responsive to changes in operating conditions of the elevator system and may also include an obstruction member movable in response to the energization circuit between a first position preventing key access through a keyhole during normal operating conditions and a second position permitting access through the keyhole during abnormal operating conditions. Accordingly, a key can only be inserted through the keyhole to actuate an unlocking bit of the auxiliary release mechanism to release the landing doors during abnormal operating conditions.

15 Claims, 7 Drawing Sheets

ELEVATOR SYSTEM AND METHOD FOR PREVENTING UNAUTHORIZED HOISTWAY ACCESS

BACKGROUND OF THE INVENTION

The invention relates to a means and method of preventing unauthorized access of personnel into the hoistway of an elevator system. In particular the invention provides a specific landing door lock with an auxiliary release mechanism which can only be actuated during maintenance or emergency conditions hereinafter referred to as abnormal operating conditions.

In modern elevator systems it is common practice to provide a lock on each landing door of an elevator system. The lock has two specific mechanisms that are employed to unlock the landing door. The first is the main release mechanism which is actuated during normal operating conditions of the elevator by a retractable cam mounted either on a car of the elevator or on the landing door. Accordingly, when the car reaches the desired floor, the main release mechanism is actuated on the neighboring landing door thereby enabling transferal of passengers between the car and the floor. Naturally there are occasions (during maintenance or emergency conditions for example) when it is necessary for authorized personnel to gain direct access to the hoistway from a floor. For this purpose the lock further includes an auxiliary release mechanism. Generally, the auxiliary release mechanism is actuated manually by an appropriate key in the possession of the service engineer or firefighter (authorized personnel) and the landing door can then be opened manually. It has become apparent that this security precaution is no longer adequate to prevent unauthorized personnel such as vandals from opening the landing door and causing damage to elevator equipment as well as endangering their own safety.

To ensure ease of use and universal applicability for all elevator systems within a particular region or area, the key for the auxiliary locking mechanisms is typically of a simple design. For example in Europe, the relevant standard, EN 81-1:1998, specifies that the key will fit an unlocking triangle which is accessible from the landing. The unlocking triangle is shaped as a solid equilateral triangle with rounded corners. A person who is determined to enter the hoistway can easily replicate a key that will fit the unlocking triangle. Occasionally, the unlocking triangle may be covered with a screw cap or plug however these are not particularly effective deterrents and do not prevent deliberate misuse.

In the United States of America it is common practice to supply an unlocking key with a semicircular profile which fits into a corresponding keyhole accessible from the landing. Instead of rotating the key, it is moved to one side which action slides an unlocking lever in the opposite direction to actuate the auxiliary release mechanism. Again, this relatively simple arrangement is no longer effective in preventing deliberate misuse.

A solution to the problem was proposed in GB 1498039. Instead of key activation, the auxiliary release mechanism of GB 1498039 is connected electrically to a manually operable switch, activation of which releases the landing door. The switch can be housed in a locked compartment in the elevator car, on the landing or in the machine room of the elevator system.

The switch, being a dedicated component to the elevator system, must always be available on site and therefore there is always an inherent risk of vandalism leading to unauthorized access to the hoistway. Furthermore, the continual pressure to reduce space consumption within the industry has led to the design of modern systems that do not have a machine room, the machine being mounted instead in the hoistway. In these installations the locked compartment must be mounted either in the car or landing, both of which are generally accessible to the public, thereby increasing the risk of vandalism and unauthorized access.

If the mechanism of GB 1498039 is to comply with the standards, the compartment containing the release switch must be capable of being unlocked using a standard key. In this instance the mechanism is no better at preventing unauthorized access than the existing key actuated release mechanism; a person merely has the additional task of manually activating the switch to open the landing doors.

In JP 08 059151 a similar arrangement is described where a manual switch is provided in the elevator car and another manual switch is provided in the control room. Only when both switches have been activated can the landing door be opened.

JP 2000072361 shows an arrangement whereby a shutter blocks the keyhole on a landing door at all times except when the car is in a docking position directly opposite the landing door. It is apparent that if this system is used, then no access is possible to the hoistway for maintenance purposes.

An alternative solution has been proposed in GB 1511838. In this solution the landing door lock includes at least one fixed obstruction intended to prevent objects other than the appropriate key from being inserted through the keyhole and actuating the auxiliary release mechanism. All objects, including the key, are prevented from being inserted along a direct path through the keyhole. Instead, the key is inserted along a non-direct path to avoid a projection provided in the keyhole. When fully inserted, an aperture in the key can accommodate the projection and therefore the key can be levered to actuate the auxiliary release mechanism.

Again the solution does not prevent the would-be vandal from attempting to gain access to the hoistway, an act which itself may be extremely hazardous as a makeshift replica key could become securely lodged in the keyhole preventing subsequent operation by authorized personnel, particularly during emergency procedures.

SUMMARY OF THE INVENTION

The principal objective of the present invention is to overcome the shortcomings of the prior art by providing a more secure means and method of preventing unauthorized access hoistway access within elevator systems.

Pursuant to this object, and others which will become apparent hereafter, one aspect of the invention resides in an elevator system having an elevator car movable within an elevator hoistway, having a plurality of landing doors. At least one blocking device is provided that is movable into a blocking position to prevent travel of the car into a temporary working space within the hoistway. An auxiliary release mechanism is mounted on at least one landing floor and has an unlocking bit. An energization circuit is provided which is operative to prevent actuation of the auxiliary release mechanism during normal operating conditions of the elevator system. A sensor is arranged to detect the presence of the blocking device in the blocking position and in response to the detection provides a maintenance indication signal to the energization circuit which in turn permits actuation of the auxiliary release mechanism.

In another embodiment of the invention, an emergency circuit is provided which is operative to provide an emergency signal to the energization circuit which in turn permits actuation of the auxiliary release mechanism upon detecting an emergency condition. In still a further embodiment of the invention, a movable member is provided which is movable in response to the energization circuit between a first position preventing actuation of the auxiliary release mechanism during normal operating conditions and a second position permitting actuation of the auxiliary release mechanism. The movable member, in one embodiment, is configured to obstruct a keyhole in the first position and in the second position permits key access through the keyhole to actuate the unlocking bit of the auxiliary release mechanism. In another embodiment, the movable member is configured and arranged to slide between the first position where it engages with the unlocking bit of the auxiliary release mechanism and the second position where the movable member engages with the unlocking bit and is additionally coupled to an actuation plate so that rotation of the actuation plate causes concurrent rotation of the unlocking bit to actuate the auxiliary release mechanism.

In still a further embodiment of the invention, the energization circuit includes an electrical device operative to act on the movable member. The electrical device, in one embodiment, is bi-directional to move the movable member between the first and second positions. In another embodiment, the movable member is biased to one of the two positions and the electrical device when energized is operative to act on the movable member against the bias to move and retain the movable member in the other of the positions.

In still another embodiment, the movable member is biased to and stable in both positions and the energization circuit is operative to provide a current pulse to the electrical device to move the movable member between the bi-stable positions.

In a further embodiment, the movable member is biased by one or more springs and/or permanent magnets and/or gravitational force.

The energization circuit includes, in one embodiment, a remote control unit, an electrical device and a receiver switch responsive to an unlock signal transmitted from the remote control unit so that when the unlock signal is transmitted to the receiver switch and the maintenance indication signal or the emergency signal is provided to the energization circuit the energization circuit actuates the electrical device to automatically unlock the auxiliary release mechanism.

For a more complete understanding of the elevator of the present invention, reference is made to the following detailed description and accompanying drawings in which the presently preferred embodiments of the invention are illustrated by way of example. That the invention may be embodied in several forms without departing from the spirit or essential characteristics thereof, it is expressly understood that the drawings are for purposes of illustration and description only, and are not intended as a definition of the limits of the invention. Throughout the following description and drawings, identical reference numbers refer to the same component throughout the several views.

BRIEF DESCRIPTION OF THE DRAWINGS

By way of example only, preferred embodiments of the present invention will be described in detail with reference to the accompanying drawings, of which.

DETAILED DESCRIPTION OF THE INVENTION

Figure 1:
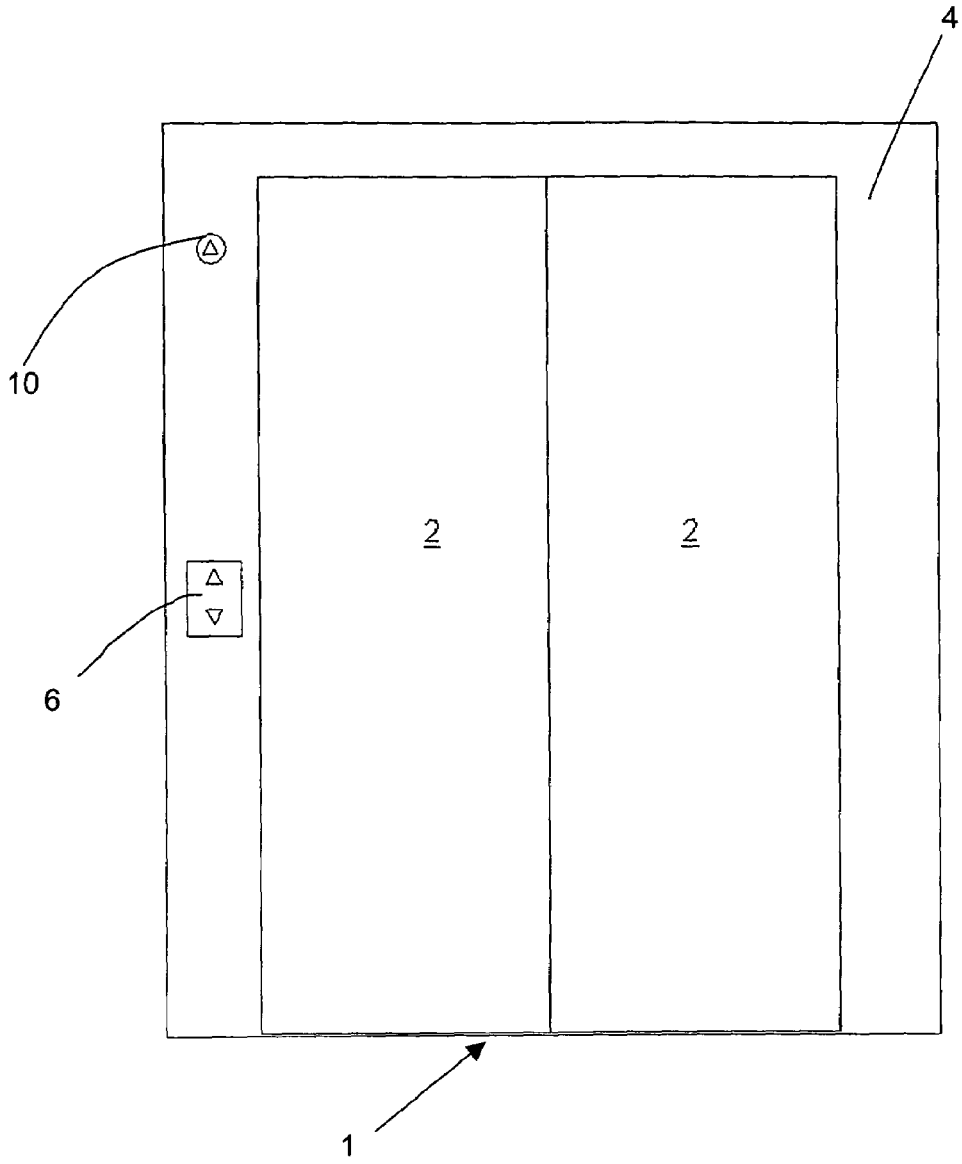
FIG. 1 (Prior art)
FIG. 1 is a plan view of a conventional elevator floor arrangement comprising landing doors fitted with a lock having main and auxiliary release mechanisms.

FIG. 1 illustrates a typical floor arrangement 1 of an elevator system within a building. The arrangement 1 generally comprises one or more landing doors 2 surrounded by a doorframe 4 housing a control station 6 which logs user requests. During normal operating conditions, whenever users wish to move up or down floors within the building they press an appropriate key on the control station 6 and a car within a hoistway of the system responds to this call. When the car is in the vicinity of the floor, it interlocks with the landing doors 2 to activate a main release mechanism to release and open the landing doors 2.

Figure 2:
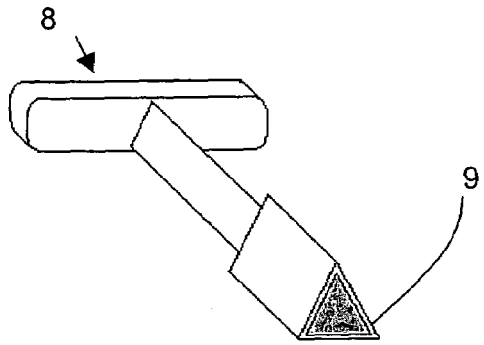
FIG. 2 (Prior art)
FIG. 2 is a perspective view of a typical unlocking triangle.
Figure 3:
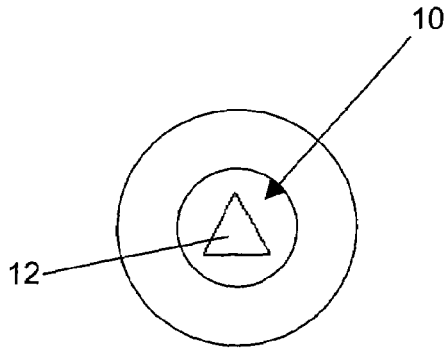
FIG. 3 (Prior art)
FIG. 3 is an expanded view of the keyhole through which the unlocking triangle of FIG. 2 is passed to activate the auxiliary release mechanism when emergency or maintenance access is required.

As previously mentioned, it is occasionally necessary for authorized personnel to gain access to the hoistway (for example to carry out routine maintenance work). For this purpose at least one of the elevator floor arrangements 1 is provided with an auxiliary release mechanism to enable the doors 2 to be released and opened when the car is not in the immediate vicinity of the floor. As best shown in FIG. 3 the auxiliary release mechanism includes a triangular unlocking bit 12 accessible through a keyhole 10 in the doorframe 4. All authorized personnel have in their possession an unlocking key 8 as shown in FIG. 2. The key 8 has an end 9 with a hollow-triangular profile corresponding with that of the unlocking bit 12. Accordingly, to gain access to the shaft the key 8 is inserted through the keyhole 10 such that the profiled end 9 surrounds and securely engages with the unlocking bit 12. Concurrent rotation of the key 8 and bit 12 actuates the auxiliary release mechanism to unlock the landing doors 2.

It will be appreciated that the keyhole 10 need not be provided in the doorframe 4, but in any other exposed surface of the elevator floor arrangement 1. In many instances, the keyhole 10 is located in a landing door 2.

Figure 4:
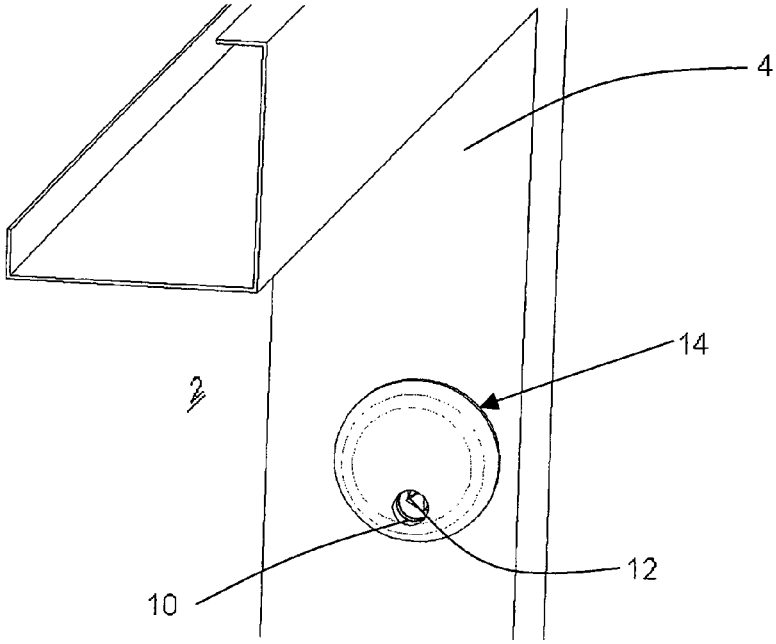
FIG. 4 is a perspective view of keyhole surround according to a first embodiment of the invention mounted on a side-facing surface of a door frame of an elevator floor arrangement.
Figure 5:
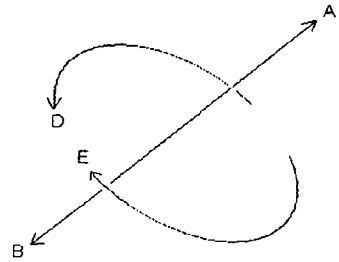
FIG. 5 is an exploded perspective view specifically illustrating components of the keyhole surround of FIG. 4.
Figure 5:
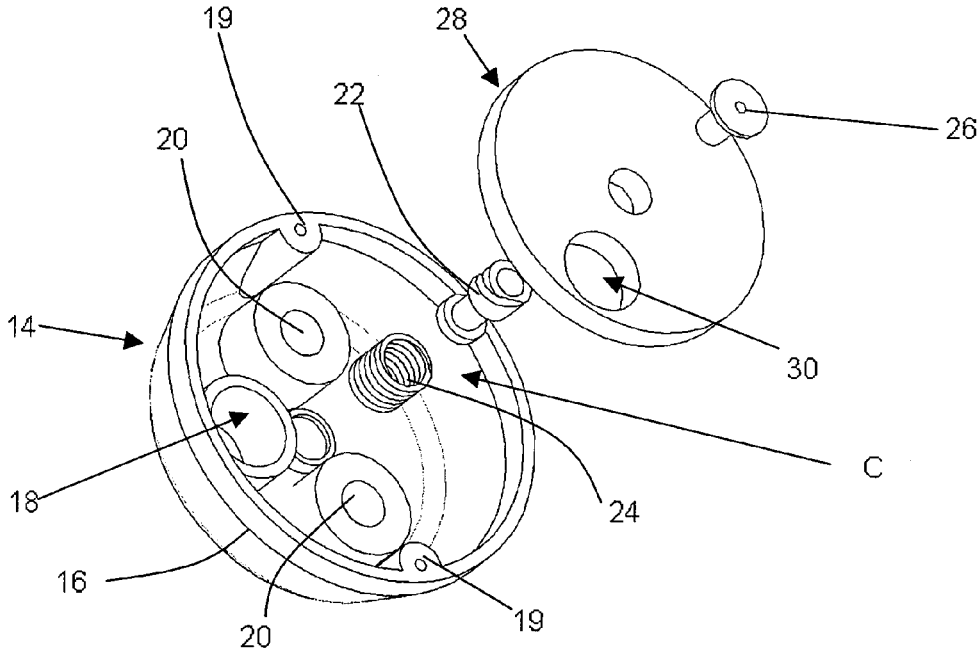

FIGS. 4 and 5 show a keyhole surround 14 according to a first embodiment of the present invention. Although FIG. 4 specifically shows the keyhole 10 provided in, and the surround 14 mounted on, a side-facing surface of a doorframe 4, it is equally acceptable for the surround 14 to be retrofitted on the floor-facing surface of the doorframe 4 so as to surround the keyhole 10 shown in FIGS. 1 and 3.

As illustrated in FIG. 5, the surround 14 includes a substantially concave housing 16 with an integral through-hole 18. The surround 14 is mounted to the doorframe 4 by screws (not shown) which engage with the screw holes 19 in the housing 16. When mounted, the through-hole 18 of the surround 14 is concentrically aligned with the keyhole 10 and a cavity C is defined between an internal wall of the housing 16 and the doorframe 4. The cavity C accommodates two electromagnets 20 that are fixed to the internal wall of the housing 16 at opposing positions equidistant from its center. A bottom end of a spiral pin 22 is mounted to the center of the internal wall of the housing 16. This pin 22 is used to support and guide a ferrous disc 28. A compression spring 24 which envelopes the pin 22 biases the disc 28 away from the housing 16 in direction A towards a screw 26 fastened to a top end of the pin 22. An access hole 30 is formed in the disc 28.

During normal operating conditions, the electromagnets 20 are not energized and the spring 24 retains the ferrous disc 28 against the screw 26 in an initial position shown in FIG. 5. In this position, the access hole 30 of the disc 28 is not aligned with the concentric holes 10 and 18 in the frame 4 and surround 14, respectively. Accordingly, the ferrous disc 28 blocks access to the unlocking bit 12.

In abnormal operating conditions, the electromagnets 20 are energized to exert an attraction force on the ferrous disc 28 in direction B. Initially this magnetic force is greater than the counteracting biasing force of the spring 24 resulting in movement of the disc 28 along the spiral pin 22 in direction B. Such movement causes simultaneous rotation of the disc 28 in the clockwise direction E. The disc 28 comes to a rest position when the opposing forces are equalized. In this position, as shown in FIG. 4, the access hole 30 in the disc 28 is aligned with the through-hole 18 of the surround 14 and the keyhole 10 in the doorframe 4. Consequently, an authorized person can introduce an unlocking key 8 through the through-hole 18, the access hole 30 and the keyhole 10 to engage with the unlocking bit 12 and release the landing doors 2.

When the elevator system returns to normal operating conditions, the electromagnets 20 are deactivated and the compression spring 24 forces the disc 28 to move in direction A causing simultaneous rotation in the counterclockwise direction D and so the disc 28 returns to its initial position as shown in FIG. 5.

Figure 6:
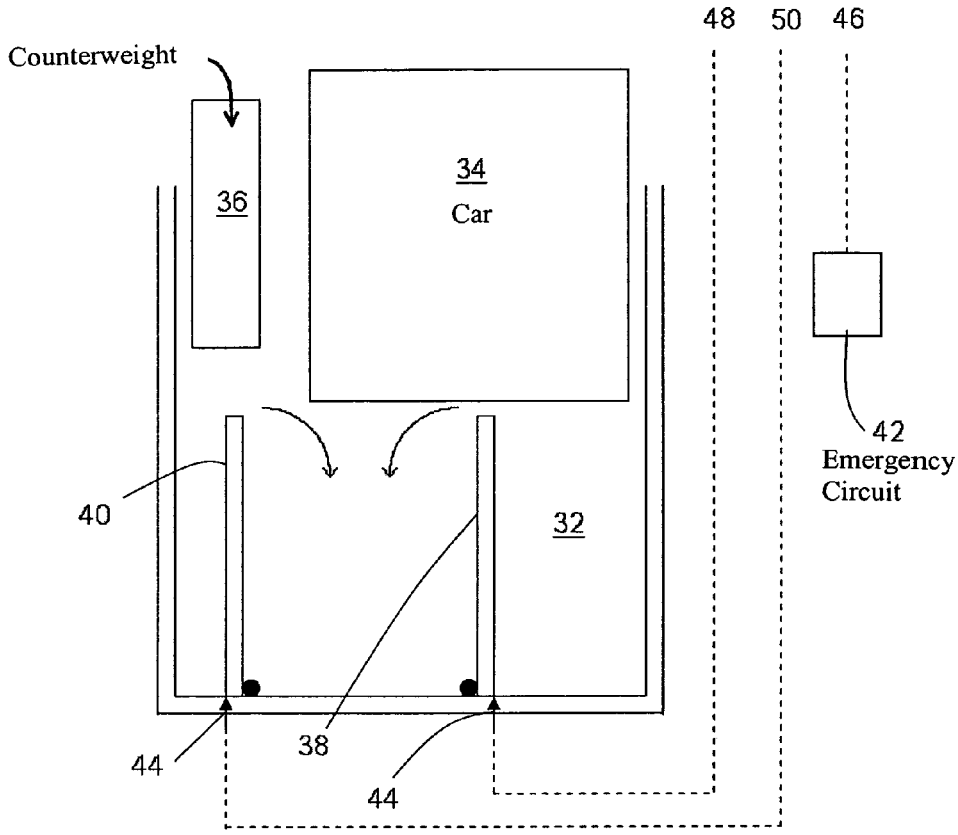
FIG. 6 is a cross-sectional, partial view of a hoistway of an elevator system incorporating the keyhole surround of FIGS. 4 and 5.

For this arrangement to work effectively, it is essential that the operating conditions of the elevator are continuously monitored. An effective way to achieve this goal is to use sensing equipment as shown in FIG. 6. In the elevator system a car 34 is connected and moves concurrently in opposite directions to a counterweight 36 within a hoistway 32.

In order to carry out maintenance or service tasks safely, it is important to provide adequate safety spaces in a pit and headroom of the hoistway 32 into which the car 34 is prevented from travelling. However, in order to reduce the space occupied by elevator systems, it is preferable that these safety spaces are temporary in nature to the extent that they are established only when required and subsequently removed when the required work has been concluded. In the present system, the pit and headroom safety spaces are established using pillars 38 and 40. During normal operating conditions, the pillars 38 and 40 lie horizontally on the pit floor.

If an engineer is scheduled to work in the pit of the hoistway 32, a car pillar 38 is brought into the upright position about its pivot point as shown in FIG. 6. The car 34 is then prevented from entering a safety space as defined by the pit floor and the top of the car pillar 38.

In a similar manner, if an engineer is scheduled to work in the headroom of the hoistway 32 or on top of the car 34, a counterweight pillar 40 is brought into the upright position about its pivot point as shown in FIG. 6. Since the counterweight 36 cannot enter the space defined by the pit floor and the top of the counterweight pillar 40, then likewise the car 34 is prevented from entering a corresponding safety space in the headroom of the hoistway 32.

The pillars 38 and 40 can be manually activated for example by an appropriate wire or rope and pulley arrangement from a machine room of the elevator system or from a control panel provided in a landing doorframe 4. Alternatively, they could be activated by electric actuators controlled by a switch in the machine room or the control panel. In a preferred embodiment, electric actuators are used which are activated by remote control from a transmitter integrated into the unlocking key 8.

Figure 7:
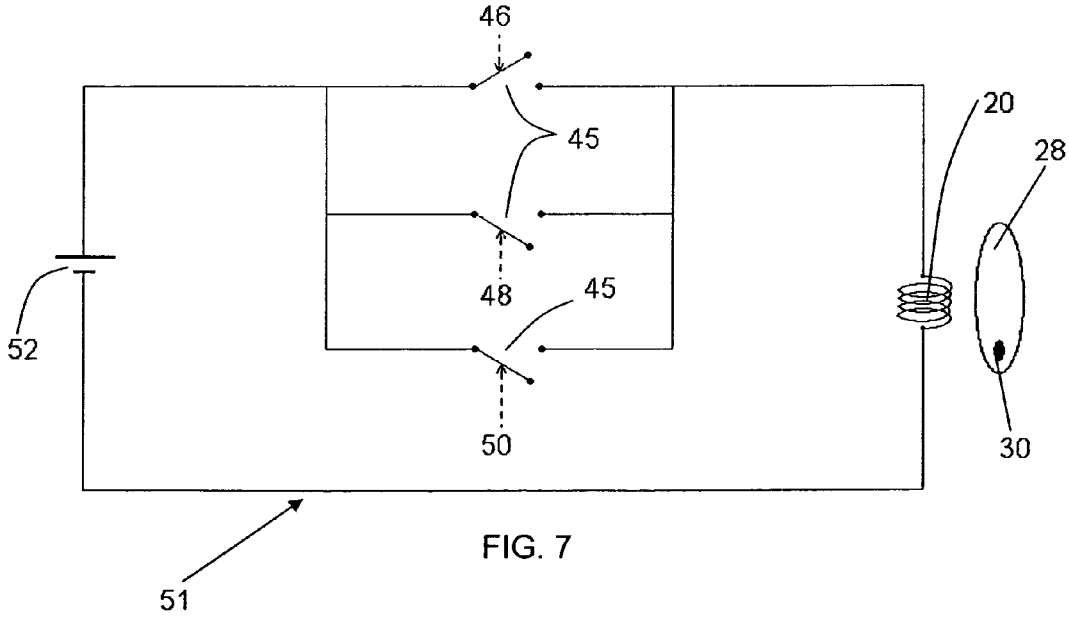
FIG. 7 is a schematic of an energization circuit for controlling movement of the ferrous disc housed within the keyhole surround of FIGS. 4 and 5.
Figure 8:
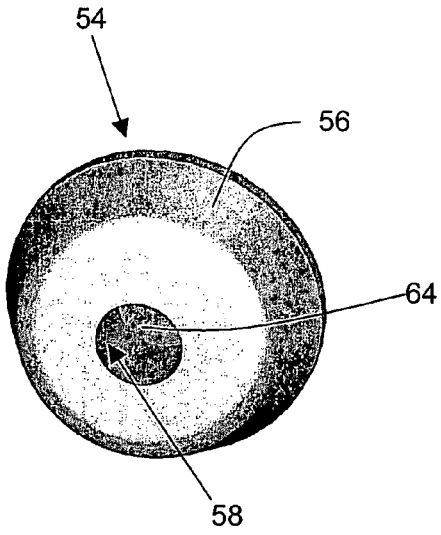
FIG. 8 is a perspective view of a keyhole surround according to a second embodiment of the invention.

As shown schematically in FIG. 6, two sensors 44 are provided on the pit floor of the hoistway 32 to provide signals 48 and 50 indicative of the position of the car pillar 38 and the counterweight pillar 40, respectively. When either pillar 38 and 40 is in the upright, actuated position, the corresponding pillar signal 48 and 50 is used to automatically close a corresponding switch 45 onto the energization circuit 51 for the electromagnets 20 in the keyhole surround 14 as shown in FIG. 7. Accordingly, the power source 52 produces a current passing through the electromagnets 20. The ferrous disc 28 is attracted towards the energized electromagnets 20 and rotated in the clockwise direction E permitting the engineer to insert an unlocking key 8 through the keyhole 10 to actuate the unlocking bit 12 and release the landing doors 2.

It will be understood that any car or counterweight travel blocking apparatus which is movable into a position where it prevents travel of the car 34 into a temporary working space could be substituted for the pillars 38 and 40. Examples include bolts or latches which extend from the car 34 to abut stops on guide rails supporting the car or on the walls of the hoistway 32, levers or latches extending from the guides rails or walls of the hoistway 32 to engage the car 34 or counterweight 36, pivotable buffers mounted in the hoistway and means for locking a governor rope in one or more predetermined positions.

In the event of a fire or other emergency, a conventional emergency circuit 42 associated with the elevator system can be used to provide an emergency signal 46 to automatically close an associated switch 45 onto the energization circuit 51. The emergency circuit 42 can be activated by signals from appropriate detectors (fire detectors, earthquake detectors etc.) or switches within the building or remotely for example from a fire station. In a preferred embodiment, in addition to the above activation means, the emergency circuit 42 also includes a receiver that is responsive to a transmitter built into the unlocking keys 8 provided to firefighters.

FIGS. 8 to 11 show an alternative keyhole surround 54 according to a second embodiment of the invention. Again the surround comprises a substantially concave housing 56 with an integral through-hole 58 which in this instance is positioned in the center of the surround 54. Screw holes 19 are provided for mounting the surround 54 to the doorframe 4. When mounted, the through-hole 58 is concentrically aligned with the keyhole 10 and a cavity is defined between an internal wall of the housing 56 and the doorframe 4. The cavity accommodates a single C-shaped electromagnet 60 that is fixed to the internal wall of the housing 56. A pin 62 is provided at an opposite side of the cavity to which a ferrous plate 64 is pivotally mounted.

Figure 9:
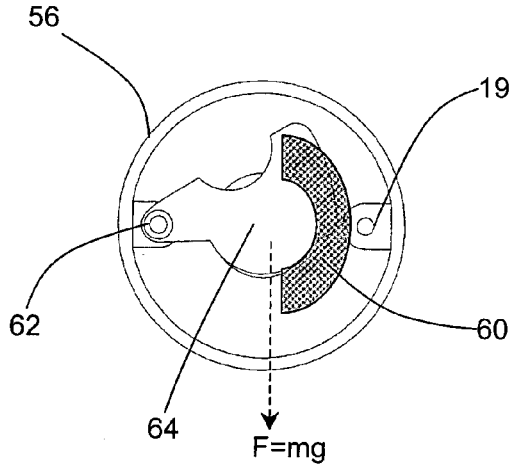
FIG. 9 is a cross-section of the keyhole surround of FIG. 8.
Figure 10:
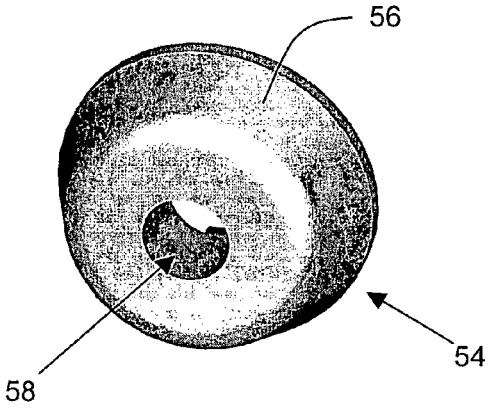
FIG. 10 corresponds with FIG. 8 but illustrating the keyhole surround in abnormal operating conditions rather than normal operating conditions.

In contrast to the previous embodiment, during normal operating conditions the C-shaped electromagnet 60 is energized and the ferrous plate 64 is retained in the position shown in FIG. 9 where it obscures the through-hole 58 of the surround 54. Accordingly, the unlocking bit 12 of the auxiliary release mechanism cannot be actuated.

Figure 11:
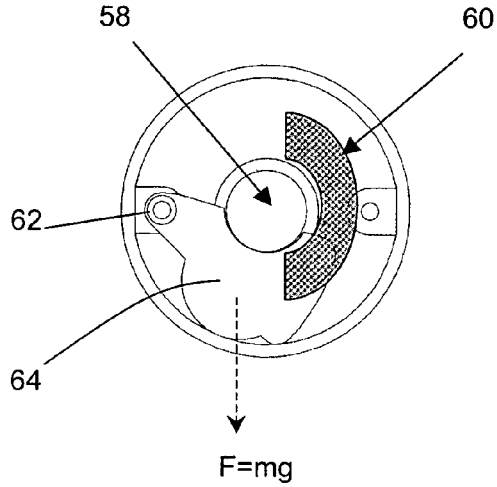
FIG. 11 is a cross-section of the keyhole surround of FIG. 10.

In abnormal operating conditions, the C-shaped electromagnet 50 is de-energized and in the absence of magnetic force from the electromagnet 50, the ferrous plate 64 pivots about the pin 62 under the force of gravity to the position shown in FIG. 11. Hence, the unlocking key 8 can be introduced through the through-hole 58 of the surround 54 and the keyhole 10 of the doorframe 4 to actuate the unlocking bit 12.

Obviously, since the electromagnet 50 is energized during normal conditions and de-energized during abnormal operating conditions (contrary, to the arrangement of the first embodiment) the energization circuit of FIG. 7 and its switches 45 would have to be modified accordingly. However, this is not a complex task especially if digital signals and control circuits are employed.

In both of the previously described embodiments, it will be understood that a small electric motor could be used in place of the electromagnets 20 and 60.

Figure 12:
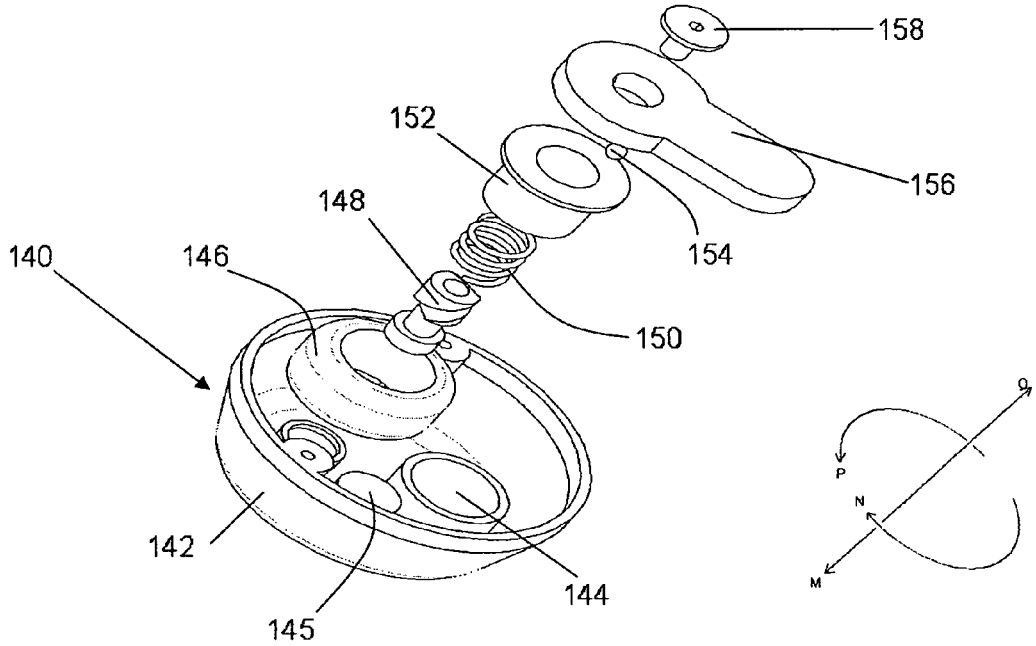
FIG. 12 is an exploded perspective view illustrating the components of a keyhole surround according to a third embodiment of the present invention.

FIG. 12 shows the components of a keyhole surround 140 according to a third embodiment of the invention. Again the surround 140 includes a substantially concave housing 142 with an integral through-hole 144 which, when mounted, is concentrically aligned with the keyhole 10 of the elevator floor arrangement 1. A base of a spiral pin 148 is mounted on an internal wall of the housing 142. The pin 148 is used to support and guide a ferrous lever 156. A compression spring 150 and a bearing surface 152 surround the pin 148 and are used to bias the lever 156 away from the housing 142 in the direction O towards a screw 158 fastened to a top end of the pin 148. A ball bearing 154 is provided between bearing surface 152 and the lever 156 to permit free relative rotation. Furthermore a coil 146 surrounds the base of the spiral pin 148. The housing 142 also accommodates a permanent magnet 145.

In contrast to the previous embodiments, the ferrous lever 156 is biased towards and stable in two positions (bi-stable). During normal operating conditions of the elevator, the lever 156 is biased by the spring 150 against the screw 158 in the position shown in FIG. 12 to obstruct the through-hole 144.

During maintenance or emergency conditions, an energization circuit provides a current pulse to the coil 146 to attract the lever 156 in direction M. This attractive force is greater than the biasing force of the spring 150, resulting in movement and rotation of the lever 156 in directions M and N respectively along the spiral pin 148. When the lever 156 is over the permanent magnet 145, the permanent magnet 145 exerts sufficient magnetic force on the lever 156 to overcome the bias of the spring 150 and so retain the lever 156 in a position where it no longer obstructs the through-hole 144.

On re-establishment of normal operating conditions, the energization circuit provides a reversed current pulse through the coil 146 to move the lever 156 in directions O and P and the spring 150 further biases the lever 156 to the initial position where it obstructs the through-hole 144.

Again, since the coil 150 needs to be energized in both directions in this embodiment, the energization circuit 51 and switches of FIG. 7 would need to be modified accordingly.

Figure 13:
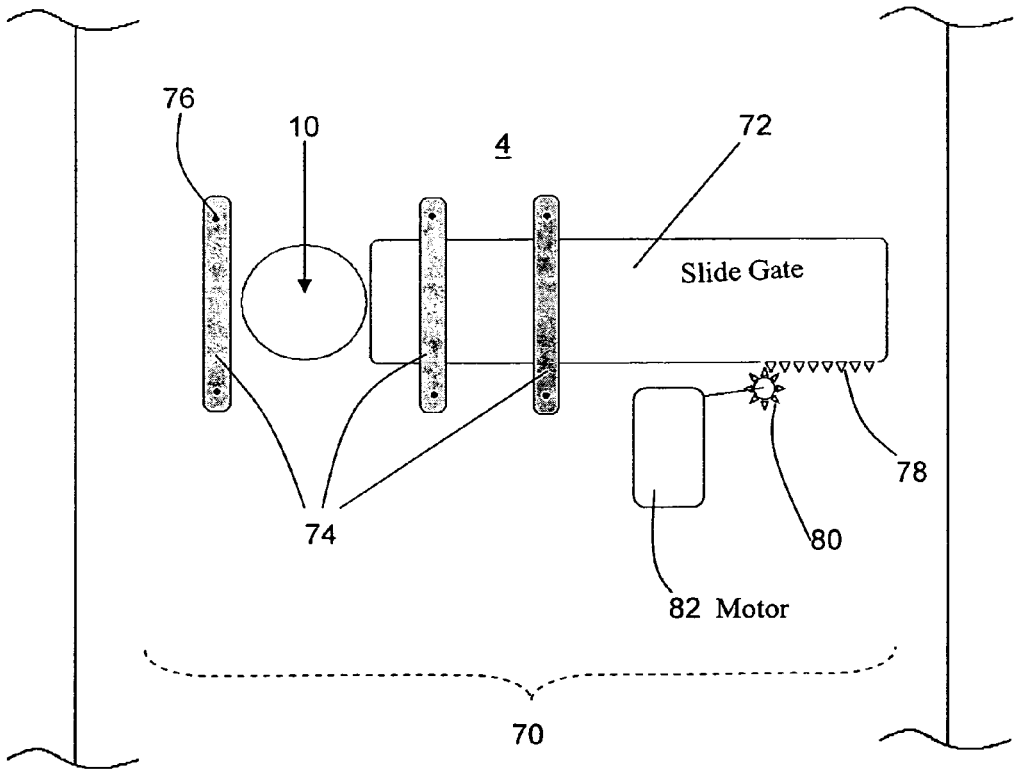
FIG. 13 is a plan view from behind a doorframe of an elevator incorporating a slide gate according to a fourth embodiment of the present invention.

FIG. 13 shows a slide gate arrangement 70 according to a fourth embodiment of the present invention. Contrary to the previous embodiments the arrangement 70 is mounted on a rear (hoistway 32 facing) surface of a doorframe 4 of an elevator system. The arrangement 70 includes a slide gate 72 that is supported on the surface of the doorframe 4 by a plurality of strappings 74 which are fastened to the frame 4 by suitable means such as rivets 76. A distal end of the slide gate is provided with a rack 78 which engages with a pinion 80 driven by a small bi-directional electric motor 82.

During normal operating conditions the motor 82 drives the rack 78 and pinion 80 so as to slide the slide gate 72 to the left as shown in the drawing to a position where it obscures the keyhole 10 in the doorframe 4. When abnormal conditions are detected, the motor 82 operates in the opposite direction to slide the slide gate 72 to the right and thereby enabling the unlocking key 8 to be introduced through the keyhole 10 to actuate the unlocking bit 12 of the auxiliary release mechanism.

As with the previous embodiment, since the motor 80 is bi-directional, the energization circuit 51 and switches 45 of FIG. 7 would need to be modified accordingly.

It is envisaged that the slide gate 72 could be biased to one of the positions, whether by a spring or by rearrangement along a vertical axis to take advantage of gravitational force, so that a unidirectional motor and simplified energization circuit could be used to drive the slide gate 72 to the other position.

It will also be recognized that when aligned along a vertical axis, one or more electromagnets could be used in place of the motor 82 to exert forces and cause an appropriate movement of a ferrous slide gate 72. Furthermore, the slide gate arrangement 70 could be mounted on an outside (floor-facing) surface of the doorframe with a cover plate to protect the components from vandalism.

Figure 14:
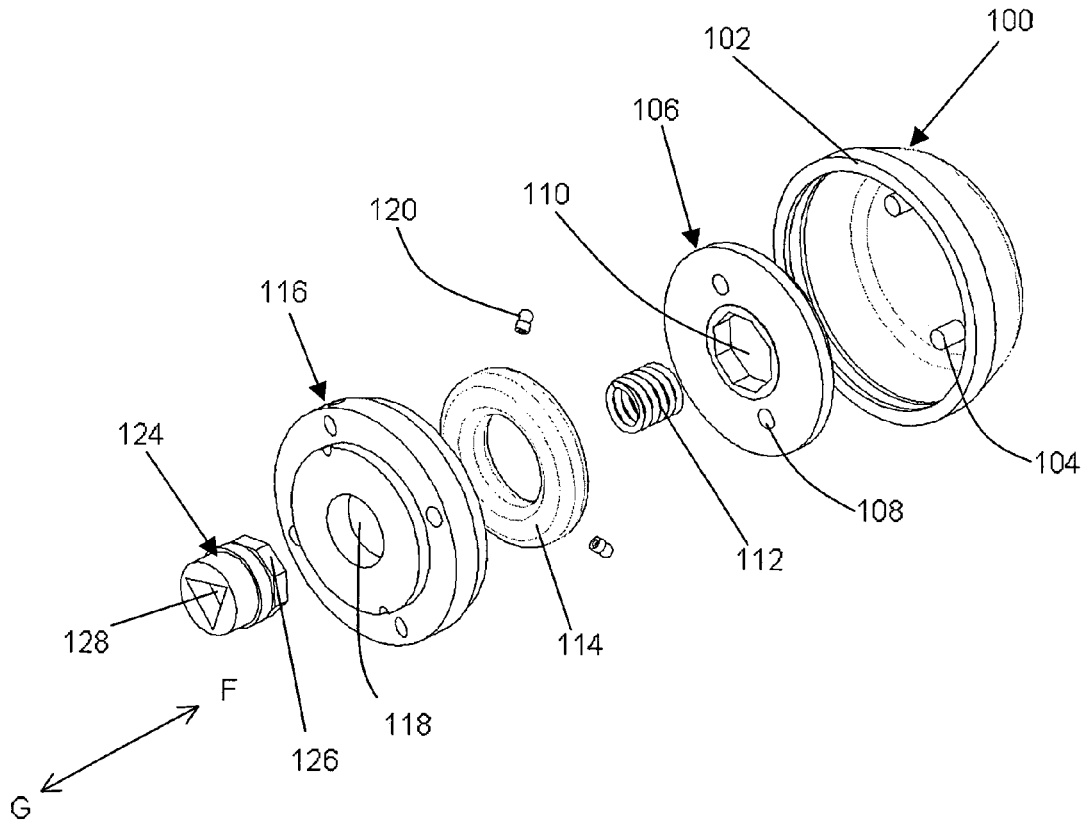
FIG. 14 is an exploded perspective view specifically illustrating components of a keyhole mounting according to a fifth embodiment of the present invention.
Figure 15:
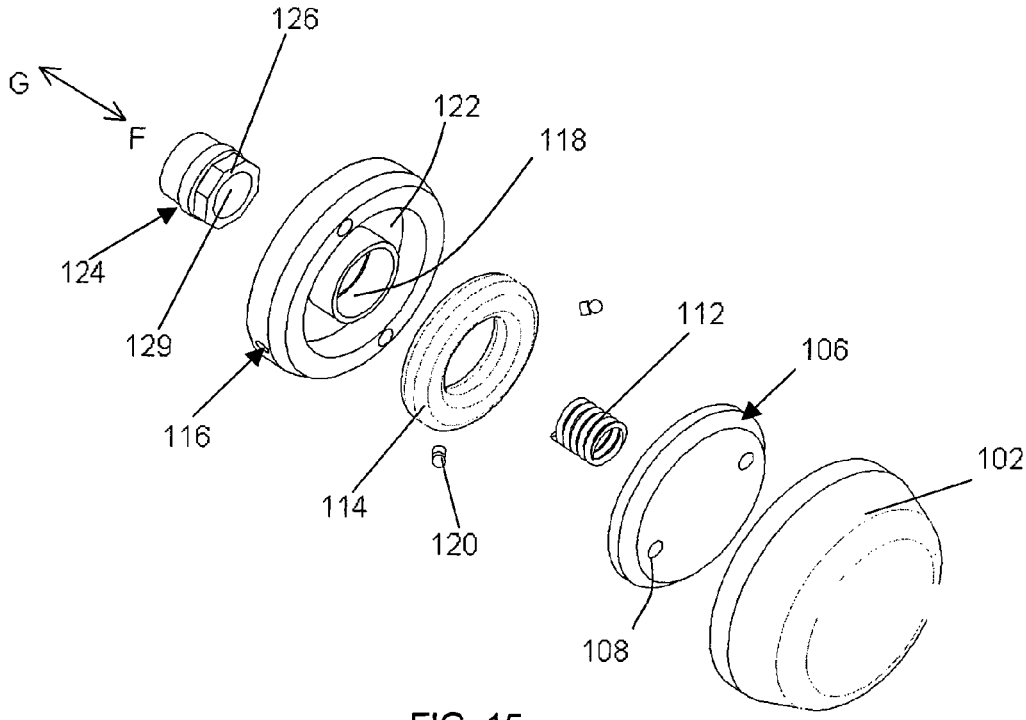
FIG. 15 corresponds to FIG. 14 but from the other side.

An obvious way to prevent unauthorized hoistway access would be to discard the keyhole 10 in the doorframe 4 altogether. However, until now it has been inconceivable to perceive an arrangement without a conventional, accessible keyhole 10 that would comply with the regulations. With this goal in mind a keyhole mounting 100 according to a fifth embodiment of the invention was developed as illustrated in FIGS. 14 and 15. As with the previously described embodiments, the keyhole mounting 100 can be retrofitted to existing elevator systems, but in contrast to the previous embodiments, the mounting 100 completely blocks the keyhole 10 in the doorframe 4 throughout all elevator operating conditions.

The keyhole mounting 100 includes a rotatable concave housing 102, an actuation plate 106, a coil 114, a base plate 116 and a ferrous slide key 124. The actuation plate 106 is mounted for concurrent rotation with the concave housing 102 by means of pins 104 and holes 108. The coil 114 is accommodated within a recess 122 in the base plate 116. The ferrous slide key 124 is accommodated within a through-hole 118 in the base plate 116. The slide key 124 has an end with a hollow-triangular profile 128 for continuous engagement with a conventional unlocking bit 12 and an opposing end with a octagonal head 126 and a hollow 129 to partially accommodate a compression spring 112.

The keyhole mounting 100 is fixed to a conventional doorframe 4, such that the through-hole 118 of the base plate 116 coincides with the keyhole 10 in the doorframe 4. The ferrous slide key 124 is biased in direction G by the compression spring 112 so that its hollow-triangular profile 128 continuously engages with the triangular unlocking bit 12 of the auxiliary release mechanism. The concave housing 102 (and the actuation plate 106) is free to rotate with respect to the base plate 116 on bearings 120.

During abnormal operating conditions, the coil 114 is energized (for example by the energization circuit 51 of FIG. 7) and thereby draws the slide key 124 against the bias of the spring 112 in direction F to a position where its octagonal head 126 engages with a corresponding octagonal socket 110 in the actuation plate 106. In this position the slide key 124 is still in engagement with the unlocking bit 12. Accordingly, rotation of the concave housing 102 will lead to simultaneous rotation of the actuation plate 106, the slide key 124 and the unlocking bit 12 to release the door 2.

Once the normal operating conditions have been reestablished, the coil is de-energized and the spring 112 forces the slide key 124 along direction G thereby decoupling it from the actuation plate 106.

Figure 16:
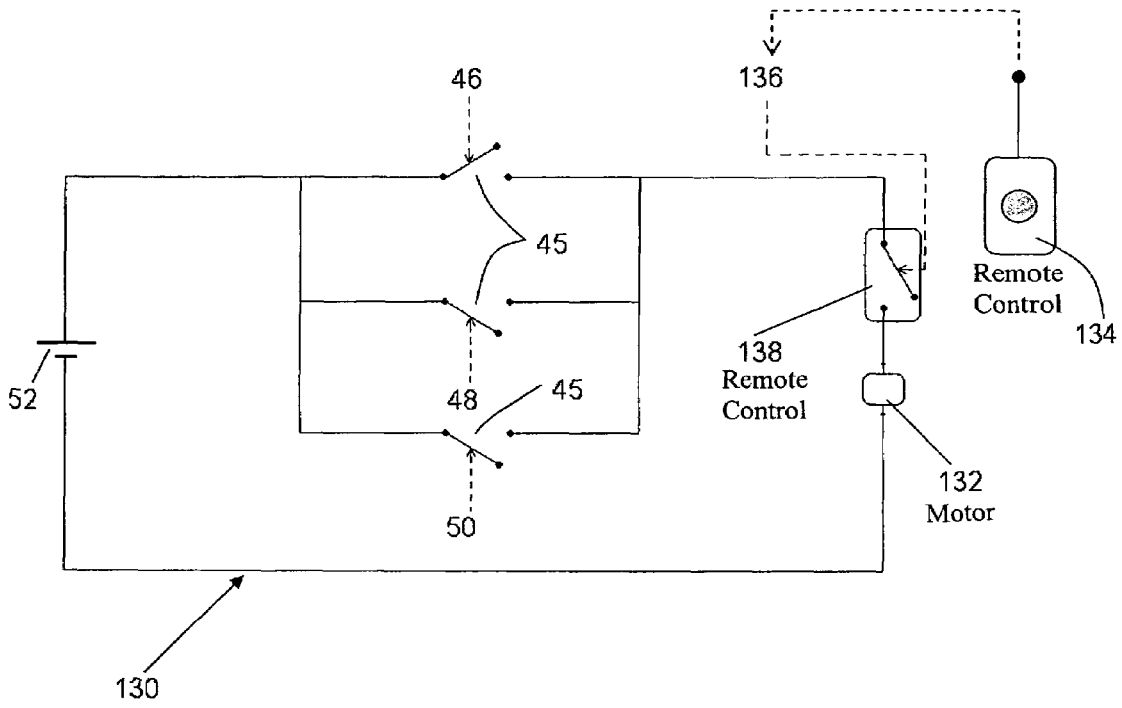
FIG. 16 is a schematic of alternative energization circuit according to a sixth embodiment of the present invention.

As equipment and procedures for remote transmission of signals have become much more reliable and secure over recent years, it is predicted that remote actuation of the auxiliary release mechanism rather than manual unlocking will become more prevalent within the elevator industry. Clearly, the present invention could be employed in such a system as illustrated in FIG. 16. The energization circuit 130 shares many of the components of the previously described energization circuit 51 of FIG. 7, but instead of selectively permitting or preventing manual actuation of the auxiliary release mechanism by means of unlocking bit 12, the circuit 130 incorporates a motor 132 which actuates the auxiliary release mechanism. Consequently as a keyhole is no longer required, the aesthetics of the floor arrangement can be improved.

As before, when maintenance work is to be carried out or during an emergency (abnormal operating conditions of the elevator system) one or more of the emergency signal 46 and the two pillar signals 48 and 50 causes the associated switches 45 to close onto the circuit 130. This, however, does not complete the circuit 130. In order to do so the authorized personnel must transmit an unlock signal 136 from a remote control unit 134 to a receiver switch 138 in the vicinity of the floor arrangement. Only when one or more of the abnormal operating signals 48, 50 and 46 and the unlock signal 136 are detected does the circuit 130 energize to activate the motor 132 which in turn unlocks the auxiliary release mechanism permitting the authorized personnel to open the landing doors and enter the hoistway.

Conceivably a solenoid could be used in place of the motor 132 to unlock the auxiliary release mechanism. Furthermore, for maintenance purposes the transmitted unlock signal 136 could also be used to activate electric motors to bring the pillars 38 and 40 into a blocking position. Thus a single signal 136 would establish the safety spaces and unlock the auxiliary release mechanism. Similarly, a fire-fighter may use a remote control unit 138 that transmits the emergency signal 46 and the unlock signal 136 simultaneously.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An elevator system, comprising:

an elevator car movable within an elevator hoistway having a plurality of landing doors;

at least one blocking device movable into a blocking position to prevent travel of the car into a temporary working space within the hoistway;

an auxiliary release mechanism mounted on at least one landing door and having an unlocking bit;

an energization circuit operative to prevent actuation of the auxiliary release mechanism during normal operating conditions; and a sensor arranged so as to detect presence of the blocking device in the blocking position, and in response to the detection provides a maintenance indication signal to the energization circuit which in turn permits actuation of the auxiliary release mechanism.

2. An elevator system according to claim 1, further comprising an emergency circuit operative to provide an emergency signal to the energization circuit which in turn permits actuation of the auxiliary release mechanism upon detecting an emergency condition.

3. An elevator system according to claim 1, further comprising a member movable in response to the energization circuit between a first position preventing actuation of the auxiliary release mechanism during normal operating conditions and a second position permitting actuation of the auxiliary release mechanism.

4. An elevator system according to claim 3, wherein the movable member is configured and arranged to obstruct a keyhole in the first position and permit key access through the keyhole in the second position to actuate the unlocking bit of the auxiliary release mechanism.

5. An elevator system according to claim 3, wherein the movable member is configured and arranged to slide between the first position where the movable member engages with the unlocking bit of the auxiliary release mechanism and the second position where the movable member engages with the unlocking bit and is additionally coupled to an actuation plate so that rotation of the actuation plate causes concurrent rotation of the unlocking bit to actuate the auxiliary release mechanism.

6. An elevator system according to claim 3, wherein the energization circuit comprises an electrical device operatively arranged to act on the movable member.

7. An elevator system according to claim 6, wherein the electrical device is bi-directional so as to move the movable member between the first and second position.

8. An elevator system according to claim 6, wherein the movable member is biased to one of the positions, and the electrical device when energized, is operative to act on the movable member against the bias to move and retain the movable member in the other of the positions.

9. An elevator system according to claim 7, wherein the movable member is biased to and stable in both positions and the energization circuit is operative to provide a current pulse to the electrical device to move the movable member between the bi-stable positions.

10. An elevator system according to claim 8, wherein the movable member is biased to and stable in both positions and the energization circuit is operative to provide a current pulse to the electrical device to move the movable member between the bi-stable positions.

11. An elevator system according to claim 7, wherein the movable member is biased by at least one of a spring, a permanent magnet and gravitational force.

12. An elevator system according to claim 8, wherein the movable member is biased by at least one of a spring, a permanent magnet and gravitational force.

13. An elevator system according to claim 2, wherein the energization circuit includes a remote control unit, an electrical device and a receiver switch responsive to an unlock signal transmitted from the remote control unit, so that when the unlock signal is transmitted to the receiver switch and the maintenance indication signal or the emergency signal is provided to the energization circuit, the energization circuit actuates the electrical device to automatically unlock the auxiliary release mechanism.

14. A method for providing access into a hoistway of an elevator system having a car movable within a hoistway, the hoistway having a plurality of floor arrangements, the method comprising the steps of:

providing an auxiliary release mechanism in at least one of the floor arrangements;

providing at least one blocking device movable into a blocking position to prevent travel of the car into a temporary working space within the hoistway;

preventing actuation of the auxiliary release mechanism during normal operating conditions; and permitting actuation of the auxiliary release mechanism when the blocking device is in the blocking position.

15. A method according to claim 14, further comprising the step of permitting actuation of the auxiliary release mechanism upon detection of an emergency condition.

* * * * *